US011826816B2

(12) United States Patent
Billaud et al.

(10) Patent No.: US 11,826,816 B2
(45) Date of Patent: Nov. 28, 2023

(54) METHOD FOR CONTROLLING THE QUALITY OF A BLIND FASTENER INSTALLATION

(71) Applicant: LISI AEROSPACE, Paris (FR)

(72) Inventors: Dimitri Billaud, Champagne sur Oise (FR); Benoit Regnard, Les Clayes sous Bois (FR)

(73) Assignee: LISI AEROSPACE, Paris (FR)

( * ) Notice: Subject to any disclaimer, the term of this patent is extended or adjusted under 35 U.S.C. 154(b) by 0 days.

(21) Appl. No.: 17/688,546

(22) Filed: Mar. 7, 2022

(65) Prior Publication Data

US 2022/0288670 A1 Sep. 15, 2022

(30) Foreign Application Priority Data

Mar. 12, 2021 (FR) ..... 2102451

(51) Int. Cl.
*B21J 15/28* (2006.01)
*B21J 15/04* (2006.01)

(52) U.S. Cl.
CPC ..... *B21J 15/28* (2013.01); *B21J 15/043* (2013.01)

(58) Field of Classification Search
CPC ..... Y10T 29/53059; Y10T 29/49776; Y10T 29/49771; Y10T 29/49764; Y10T 29/49766; B21J 15/285; B21J 15/043; B21J 15/28; B21J 15/10; B25B 23/14
See application file for complete search history.

(56) References Cited

U.S. PATENT DOCUMENTS 4,163,311 A * 8/1979 Sigmund ..... B25B 23/14 73/761
7,503,196 B2 * 3/2009 Chitty ..... B21J 15/10 72/21.4
9,669,457 B2 6/2017 Bigot et al.
(Continued)

FOREIGN PATENT DOCUMENTS

EP 0738550 10/1996
EP 0738551 10/1996
(Continued)

OTHER PUBLICATIONS

Charvet, Pierre, Preliminary Search Report, dated Nov. 25, 2021, 2 pages, Republic of France National Institute of Industrial Property, Courbevoie, France.

*Primary Examiner* — Lee A Holly
(74) *Attorney, Agent, or Firm* — Henricks Slavin LLP

(57) ABSTRACT

This relates to a method for the quality control of a blind fastener installation in a structure comprising a sleeve and a core bolt, with a deformation of a rear side of the structure, a signal being generated during the installation process. The process includes a) identification of two notable points of the signal, chosen among: pulling start point (S1); buckling (B1) of the sleeve; contact (B2, S2) of the sleeve or of the core bolt; force setpoint (B3) or fracture (S3) of a portion of the core bolt; b) estimation of a first parameter as a function of a notable point, characterizing a bulb in contact with the rear side; c) estimation of a second parameter as a function of a notable point, characterizing a tension applied in the core bolt; and d) for each estimated parameter, comparison with a condition that indicates the proper installation of the fastener.

16 Claims, 5 Drawing Sheets

(56) References Cited

U.S. PATENT DOCUMENTS

| | | | |
|---|---|---|---|
| 10,894,284 | B2 | 1/2021 | Leger et al. |
| 2008/0251268 | A1 | 10/2008 | Kushida |
| 2015/0196951 | A1 | 7/2015 | Bigot et al. |
| 2019/0283109 | A1 | 9/2019 | Leger et al. |

FOREIGN PATENT DOCUMENTS

| | | |
|---|---|---|
| EP | 1731773 | 12/2006 |
| EP | 0970766 | 9/2012 |
| FR | 1377442 | 11/1964 |
| FR | 2999707 | 6/2014 |
| FR | 3016417 | 7/2015 |
| FR | 3078906 | 9/2019 |
| WO | WO 2018178186 | 10/2018 |

* cited by examiner

METHOD FOR CONTROLLING THE QUALITY OF A BLIND FASTENER INSTALLATION

BACKGROUND

The present invention concerns the installation of blind fasteners. More specifically, this invention relates to a blind fastener installation system whereby a blind fastener is installed for the purpose of joining several metal sheets together, and a quality control inspection of the assembly is carried out.

It is common practice to join two or more sheets using a blind fastener, i.e. a fastener that requires access to only one side of the sheets to be joined. Such connections can be made using a blind rivet with a core bolt inserted into a sleeve, or using blind nuts installed via a threaded mandrel. The core bolt is shaped at one end to enable it to be gripped by a tool for pulling or screwing. The core bolt has at a second end, opposite the first end, a thread engaged with an internal tapping of the sleeve, or an enlarged diameter head relative to the diameter of the core bolt, engaged with one end of the sleeve.

A blind connection is typically formed by inserting the blind nut or rivet into a pre-drilled bore hole in the sheets to be joined. A tooling grips the first end of the core bolt or mandrel and pulls or screws said core bolt or mandrel while holding the blind nut or sleeve against an accessible face of a sheet metal. The differential force exerted on the sleeve or nut causes a physical deformation of the sleeve or the blind side of the nut, creating a second bearing surface on the blind side commonly referred to as the "bulb".

The core bolts or mandrels typically include a shear groove designed to fracture when the pulling or torques applied exceed a certain level. Examples of such rivets or mandrels are described in document FR3016417, document FR1377442 or document EP1731773A2.

The side of the assembly where the bulb is formed is not accessible making it impossible to visually determine whether the bulb has properly formed, if it is of sufficient diameter, if it is in contact with the blind side, and whether it has formed a suitable shape.

A defective blind fastener installation may not ensure the proper joining of the sheets since the bearing surface of the bulb against the blind face is insufficient, or non-existent, or because the two walls of the bulb are not in abutment with each other.

The various defects relating to the bulb may include:

No bulb formation: the sleeve has buckled slightly, or has not buckled sufficiently and the sleeve has formed a barrel shape (FIG. 9); this defect may be due to a number of factors including a manufacturing defect of the sleeve, e.g. insufficient or incorrectly placed annealing, the use of an incorrectly calibrated tool that does not pull at the required force, or the choice of fastener is too short relative to the thickness of the structure to be clamped;

Bulb formation which only partially bears on the blind face: the sleeve deforms into a bulb, but the bulb is not fully "seated" on the blind face and forms an umbrella shape; this defect may occur when the length of the inserted fastener is too long relative to the thickness of the structure to be clamped (FIG. 6);

Improperly formed bulb shape: the sleeve deforms into a bulb where the two walls are not in contact with each other; the bulb is bell-shaped;

Bulb forms partially inside the drill hole: this defect appears when the clamping capacity of the inserted sleeve is too low relative to the thickness of the structure, or when the diameter of the sleeve is too small relative to the diameter of the drill hole.

In all cases, an improperly formed bulb shape, or one that is not fully "seated" against the blind face compromises the strength of the assembly, particularly because the pre-load applied in the assembly is non-existent or insufficient.

To ensure the proper installation of a blind fastener, it is common practice to use tools equipped with sensors capable of detecting signals coming from the tooling during the installation of the blind fastener, followed by the processing of said signals through various algorithms to deduce, by comparison with predefined curves or values, the status of the fastener installation. The signals are frequently converted into force-displacement curves, in which the pulling force is plotted on the y-axis while the displacement of the core bolt or mandrel is plotted on the x-axis.

Document U.S. Pat. No. 7,503,196 provides instructions for the comparison of a force-displacement curve to an envelope of force-displacement curves obtained empirically through numerous tests. If the measured curve "breaks out" of this envelope, then it is concluded that the fastener installation is defective. The disadvantage of this process is that the envelopes cannot rule out all types of defects because the envelope would consequently be very large, nor can they rule out all types of installations (particularly installations with various configurations of structural thickness). This process also has the disadvantage of requiring a relatively long analysis time, since each point on the curve must be compared with maximum and minimum values over a certain range of displacement.

Document EP0970766 provides instructions for the comparison of only selected points of the force-displacement curve with empirically obtained force-displacement ranges. This method also does not guarantee that the blind fastener is properly installed because it is unable to rule out all types of defects.

Other algorithms focus on using the force-displacement curve in real time to stop a pulling force before it becomes too great and irreparably damages the fastener.

For example, Document WO2018178186A1 describes a method for controlling the quality of a process for assembling two components together by means of a blind nut, in which the force exerted by the tooling and the displacement of the tooling are recorded during the installation of the blind nut. This document provides instructions for calculating the derivative of the displacement relative to the force in a continuous or regular manner, and for interrupting the installation process as soon as the value of this derivative exceeds a predetermined value. This predetermined value is defined to indicate that the physical deformation of the sleeve is complete, as any further pulling force would cause an unnecessary and significant increase in the force exerted by the tooling on the nut.

This real-time process, however, does not indicate the proper or defective quality of the nut installation. It only provides a clearer indication of when the pulling force should be stopped.

This is an obstacle for the use of blind fasteners in certain fields of application requiring a high level of reliability of the assemblies, for example in the fields of automotive or aeronautical construction.

There is therefore still the need for a quality control method of the blind fastener installation that can be performed in a comprehensive, reliable, and time-efficient manner.

SUMMARY

The purpose of the present invention is to provide a quality control method for a blind fastener installation to effectively determine the character of the defect of said blind fastener installation.

For this purpose, the present invention details the quality control method for the installation of a blind fastener comprising a sleeve and a core bolt, the blind fastener being inserted into a pre-drilled bore hole in a structure, and then locally deformed by means of a tool that pulls or screws the core bolt to deform the sleeve into a bulb on a rear side of the structure until a driving portion of the core bolt fractures indicating that the installation of the blind fastener is complete, with at least one force-displacement signal or torque-angle signal having been generated during the installation of the blind fastener. The quality control process comprises the following steps:

a) identification of at least two notable points from at least one signal, the at least two notable points having been selected from: a pulling start point, or a screwing start point; a buckling point of the sleeve; a contact point of the sleeve between the bulb and the rear side of the structure or a contact point of the core bolt between the head of the core bolt and the collar of the sleeve; and a force setpoint or a fracture point of the driving portion of the core bolt;

b) estimation of at least one first parameter as a function of at least one of the at least two notable points identified in step a), in order to check that the bulb is formed and is in contact with the rear side of the structure;

c) estimation of at least one second parameter as a function of at least one of the at least two notable points identified in step a) in order to check that a predefined tension is applied in the corebolt once the blind fastener has been installed;

d) for each estimated parameter, comparison with an associated predefined condition that indicates the proper installation of the fastener;

the installation is said to be defective if at least one result of the comparison does not meet the predefined condition.

The method ensures that a bulb has been properly formed, that the two walls of the bulb are in contact with each other, and that the entire surface of the bulb is in abutment with the blind side of the parts to be assembled.

According to specific embodiments of the invention, the method includes the following steps:

an estimation of the first parameter comprising the calculation of the pulling force at the buckling point with a percentage range of pulling force at the setpoint;

an estimation of the first parameter comprising the calculation of a ratio of the difference in pulling force between the contact point of the sleeve and the buckling point relative to the difference in displacement between the contact point of the sleeve and the buckling point, and the comparison of the ratio to a minimum value;

an estimation of the first parameter comprising the calculation of the ratio of the difference in displacement between the contact point of the sleeve and the buckling point, and the displacement of the core bolt between the pulling start point and the force setpoint, and a comparison of the ratio to a range of percentages;

an estimation of the first parameter comprising the calculation of a difference in displacement between the contact point of the sleeve and the buckling point and comparing it with a percentage of the difference between an expected theoretical bulb diameter and a theoretical diameter of the drill hole into which the fastener is inserted;

an estimation of the second parameter comprising a comparison of the pulling force at the setpoint, or torque at the fracture point, or a torque at the contact point of the core bolt, with a predefined range of values;

an estimation of the second parameter comprising the comparison of a ratio of torque difference and a displacement of the core bolt between the fracture point and the contact point of the core bolt with a predefined range of values;

an estimation of the second parameter comprising the comparison of a difference of rotation angle of the core bolt between the contact point of the core bolt and the rotation start point with a predefined range of values;

an estimation of the second parameter comprising a comparison of the difference between the torque at the fracture point and an average of a torque between the contact points of the core bolt and the screwing start point with a predefined range of values;

the method comprises an additional step of estimating at least a third parameter, as a function of at least one of the at least two notable points identified in step a), in order to check that a head of the core bolt is in contact with the collar of the sleeve;

an estimation of the third parameter comprising the comparison of a torque difference between the contact point of the core bolt and the screwing start point with a percentage range of a pulling force difference between the setpoint and the pulling start point;

the method comprises an additional step of estimating at least a fourth parameter as a function of at least one of the at least two notable points identified in step a), in order to check that the sleeve has not rotated while screwing the core bolt into the sleeve;

an estimation of the fourth parameter comprising the calculation of a derivative of the torque-displacement curve between the fracture point and the contact point of the corebolt, and checking the sign of said derivative;

and estimation of the fourth parameter comprising the calculation of a centered derivative of the torque-displacement curve between the fracture point and the contact point of the corebolt over at least two adjacent values, and checking the sign of said derivative;

the method further comprises a filtering step of the at least one signal;

the filtering step comprises: the application of an increasing monotonicity filter to a force-displacement signal corresponding to a pulling step of the core bolt, to eliminate potential points where the displacement might decrease or stagnate, or the application of a decreasing monotonicity filter to a force-displacement signal corresponding to the screwing step of the core bolt, to eliminate potential points where the displacement might decrease or stagnate; and resampling in base space.

The invention also concerns a device for implementing the above-described installation quality control method, said device comprising processing means capable of identifying the at least two notable points of the at least one signal and estimating the at least first and second parameters.

BRIEF DESCRIPTION OF THE DRAWINGS

The invention will be better understood upon reading the following description, given only as a non-limiting example, and made with reference to the drawings in which.

DESCRIPTION

Figure 1:
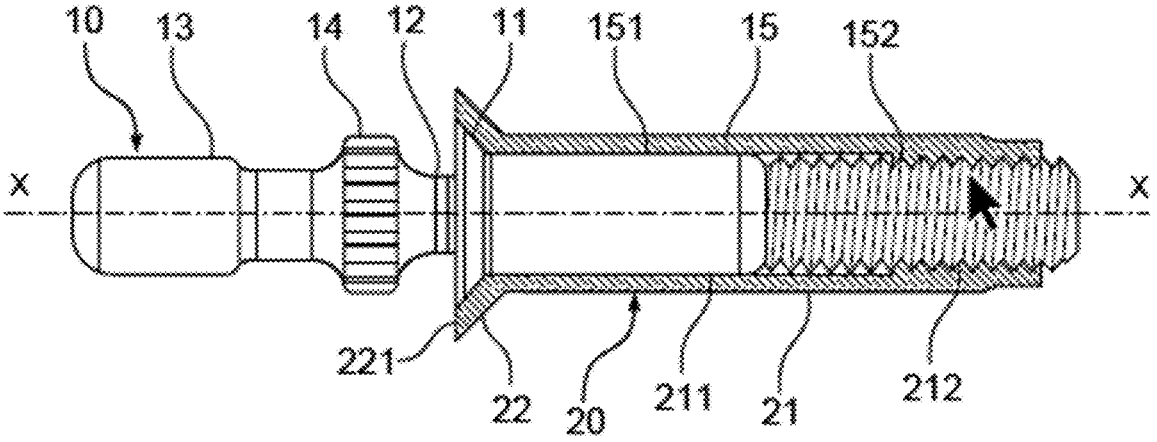
FIG. 1 is a view of a state of the art blind fastener.

FIG. 1 shows a blind fastener 100 marketed by the applicant under the name of OPTIBLIND™ (registered trademark). The blind fastener 100 comprises a core bolt 10 and a sleeve 20 in which the screw is partially housed and extends longitudinally along an X axis. The core bolt 10 comprises a countersunk head 11, a driving portion 13 extending from the countersunk head, a shear groove 12 at the junction between said head and the driving portion, and a cylindrical shaft 15 located in the sleeve 20 comprising a threaded portion 152. The sleeve 20 comprises a tubular body 21 with, in the upper part, an enlarged collar 22 suitable for receiving the cylindrical shaft 15 and the countersunk head 11 of the core bolt 10 respectively. A section of the sleeve includes an internal tapping 212 capable of engaging with the thread 152 of the core bolt. The remainder of the inner surface 211 of the sleeve is smooth.

The driving portion 13, is intended to operate with an installation tool of the type shown schematically in FIG. 2 and described below. As shown in the illustration, the driving portion 13 comprises a portion 14 capable of transmitting a torque between the installation tool and the core bolt 10. The driving portion is also capable of transmitting a pulling force exerted by said tool to the core bolt 10. The shear groove 12 is designed to fracture when the torque applied to the core bolt 10 exceeds a certain level.

Figure 2:
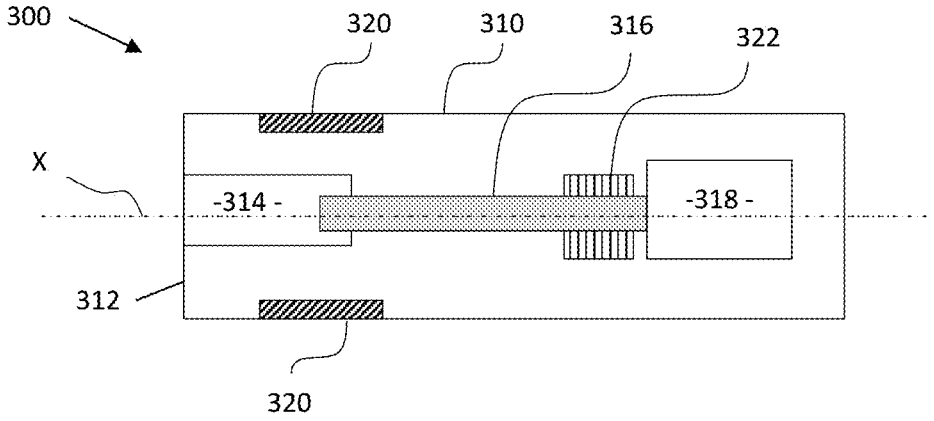
FIG. 2 is a schematic view of a tooling for the installation of a blind fastener of type FIG. 1.

FIG. 2 schematically represents a cross-sectional view of a tool 300 capable of installing the fastener 100. An example of such a tool and its use are detailed in the applicant's patent FR3078906B1 and will not be described in detail here.

The tooling 300 comprises a body 310 with a bearing face 312, a housing 314 for receiving the gripping element 13 of the blind fastener 100, and a rotating drive shaft 316 driven by a motor 318, capable of driving the fastener 100 in the axial direction X by means of a ball screw or directly in rotation around the X axis.

The tooling 300 comprises four strain gauges 320 installed on the outer surface of the body 310, equidistant from each other, forming a Wheatstone bridge. Multiple gauges may be installed on the body. The strain gauges measure the bearing force exerted on the bearing face 312 on the collar 22 of the sleeve during the pulling force which is propagated into the body 310. Alternatively, the tooling may not include a strain gauge but instead comprises a current sensor for the drive mechanism. Regardless of the technology used, the signals emitted by the strain gauges, or the current sensor are representative of the pulling force F exerted on the fastener 100.

The tooling further includes an angle sensor 322, capable of measuring an angular position a of the drive shaft 316.

Figure 3:
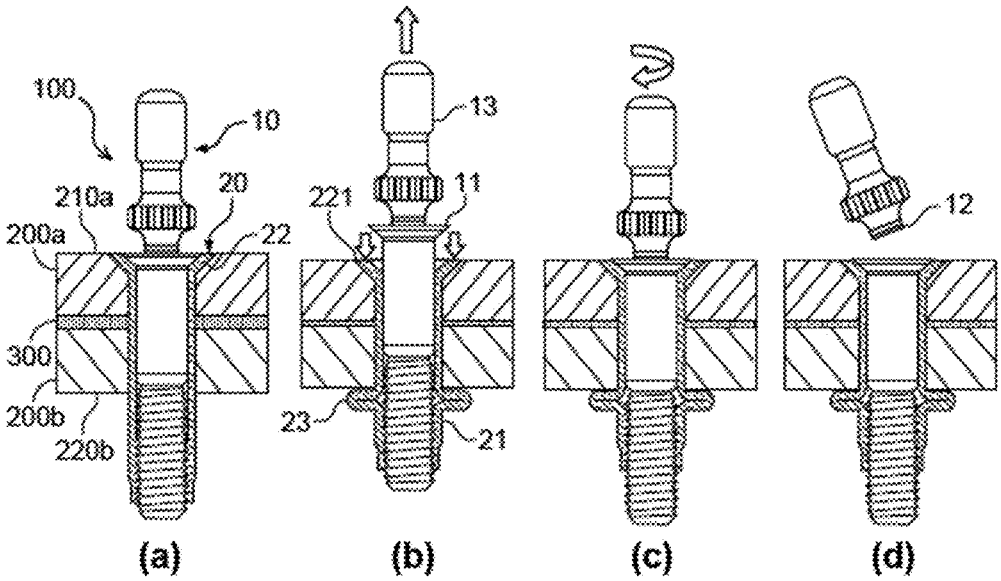
FIG. 3 is a schematic view of an installation sequence of a blind fastener of FIG. 1 by means of a tooling of FIG. 2.

FIG. 3 schematically shows the main steps for the installation of the fastener 100 for assembling a structure 200 comprising a first part 200*a* and a second part 200*b* by means of a tooling 300.

The installation of the fastener 100 consists of the following main steps:

a) insertion of the fastener 100 into a bore hole pre-drilled through two parts 200*a* and 200*b* of the structure. The fastener 100 is inserted through the front face 210*a* of the first part 200*a* opposite the rear face 220*b*, referred to as the blind face, of the second part 200*b*; a layer of interposing mastic 300 may possibly be present;

b) insertion of the driving portion 13 into the housing 314 of the tooling, then exertion of pulling force on the core bolt 10 while simultaneously blocking the sleeve 20 by pressure in the opposite direction, exerted by the bearing face 312 of the tooling 300 on a surface 221 of the collar 22, until the formation of a bulb 23 on the tubular body 21 of the sleeve. When the bulb is properly formed, it presses against the blind face of the assembly so that the structural parts 200*a* and 200*b* are clamped together between the bulb 23 on the one hand, and the collar 22 and the core bolt head 11 on the other;

c) screwing of the core bolt 10 into the sleeve 20 until the head 11 of the core bolt meets the collar 22 of the sleeve; and d) further screwing until the driving portion 13 fractures at the shear groove 12; the fracturing of the core bolt 10 determines that the required tension is applied in the assembly. FIG. 3*d* shows the final state of assembly of parts 200*a* and 200*b* with the fastener 100 permanently installed.

Other tooling can of course be used for the installation of the fastener 100. For example, a first tooling can be used to exert pulling force on the driving portion 13 and then a second tooling can be used to screw the core bolt 10 into the sleeve 20 and fracture the driving portion.

Figure 4:
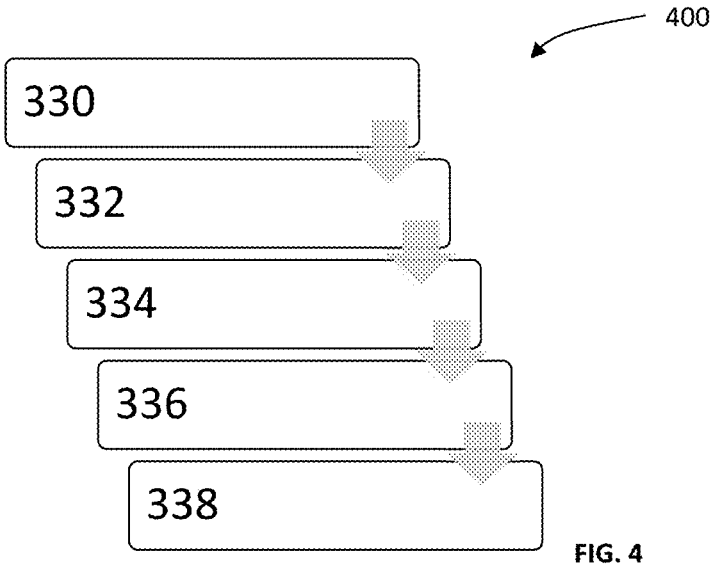
FIG. 4 is a schematic view of a device for controlling the quality of a blind fastener installation of type FIG. 1.

A blind fastener installation control device 400 will be described in relation to FIG. 4. This device may be implemented for blind fasteners installed by pulling force only, not requiring a screwing step, and whose driving portion fractures when the pulling force applied exceeds a certain level. This device can also be used for blind fasteners installed by torque only, not requiring a pulling step, and whose driving portion fractures when the torque applied exceeds a certain level.

The control device 400 preferably comprises an amplifier 330 capable of amplifying the electrical signals emitted by the strain gauges 320 and the angle sensor 322. The connection between the strain gauges 320, respectively the angle sensor 322, and the amplifier may be wired or wireless.

After amplification, the electrical signals are preferably filtered by filtering devices 332 with a bandwidth corresponding to the frequency range of the received signals.

Processing devices 334 are configured to process the electrical signals, after amplification and filtering. These processing devices are configured specifically to calculate parameters during the pulling and screwing steps, specifically to identify certain pulling or torque and displacement values from the signals received.

Comparison devices 336 are further configured to compare the parameters to a predefined value or range of values. Depending on the result of this comparison, the deformation of the threaded sleeve is considered to have a proper or defective quality.

Transmitting devices 338 are further configured to transmit a signal informing whether the installation of the blind fastener 100 is proper or defective, following the pulling step, or the screwing step. This information signal can be a sound signal, or a visual signal presented on a screen to an operator, on a screen fitted to the tooling 300, or a signal transmitted through a communication protocol, directed to a computer equipment or device of an industrial production unit, for example an automated assembly line.

The control device 400 may be incorporated in a remote computer, which may or may not be connected to the tooling 300 or integrated into the tooling 300.

The method for controlling the installation of a blind fastener 100 described above will now be described. The principle of the method lies in identifying the specific points of pulling force, torque and displacement, calculating parameters based on some of these specific points to check whether certain criteria are met, and comparing the results to a predefined condition, usually established by testing groups of fasteners, e.g. by diameter, in different configurations, e.g. in structures of different thicknesses, within the clamping range of the fastener and outside this clamping range, using different tools.

For this purpose, during the pulling step, the force signals emitted by the strain gauges 320 and the angle measurements a emitted by the angle sensor 322 are sent to the amplifier 330, each signal being sent at a frequency specific to the strain gauges and the angle sensor, which are preferably identical. The signals are then possibly filtered by the filtering devices 332. The processing devices 334 process the angle measurements to eventually transform them into displacement X—some angle measurements, however, can be processed without being transformed into displacement. The processing devices 334 sample the pulling force or torque.

Figure 5A:
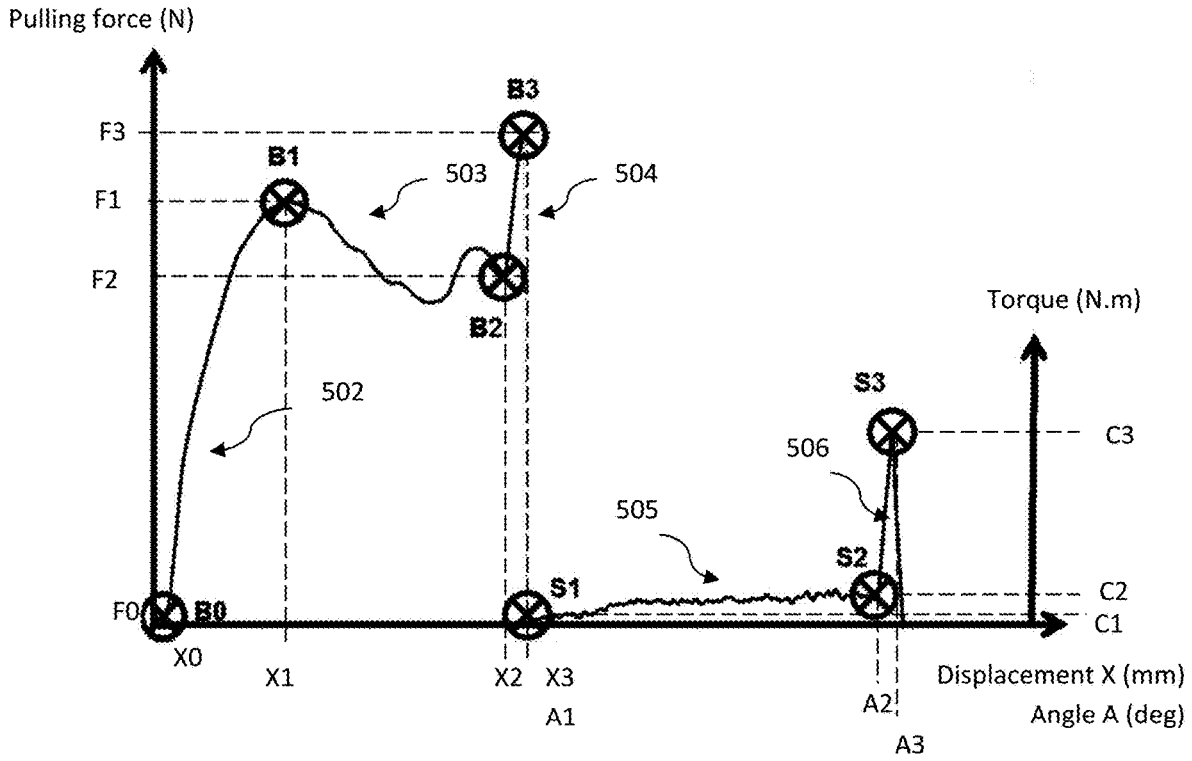
FIG. 5A is the installation curve of a blind fastener of the pull-screw type representing a pulling force and a torque applied as a function of a displacement of the core bolt during the pulling and screwing steps.

The processing devices 334 thus allows the pulling forces F or torques C and angles $\alpha$ to be processed to create a pulling force or torque versus displacement curve. FIG. 5A shows a pulling force/torque versus translational and angular displacement curve obtained during the installation of a pulled and then screwed fastener. In this figure, the displacement of the core bolt 10 and the angle of rotation A of the screw are indicated on the X axis, while the pulling force F is indicated on the Y axis on the left of FIG. 5, and the torque C on the Y axis on the right of FIG. 5A.

According to studies conducted by the applicant, a blind fastener of the type comprising a core bolt and a sleeve, installed either by a pulling step followed by a screwing step, or by a screwing step alone, or by a pulling step alone, is properly installed if the following two criteria are met:

1. the bulb is properly formed and in contact with the rear face of the structure,
2. sufficient tension is applied in the screw.

Optionally, an additional criterion is to check that the screwing of the core bolt into the sleeve has been performed without rotation of the sleeve when the core bolt is threaded. Another optional criterion is to check that the head of the core bolt is in contact with the collar of the sleeve, when the core bolt of the blind fastener has an enlarged, usually countersunk, or protruding head.

A method for controlling the installation of a blind fastener of the above mentioned type in which the core bolt 10 is a screw comprising an external thread, thus comprising the estimation of at least one parameter allowing the evaluation of each of the aforementioned at least two criteria, and the comparison with a predefined condition which may be a threshold value (minimum or maximum) or an acceptable range of values. If any of the criteria are not met, then the installation is considered unsatisfactory.

For this purpose, the applicant has demonstrated that during the installation of the fastener in structures to be assembled, a signal representative of the displacement of the core bolt as a function of the pulling force and/or the torque exerted on said core bolt must be generated, then several characteristic points must be detected. It is preferable for the curve to be filtered to improve detection accuracy. For a fastener 100 detailed above, at least two points among the following seven characteristic points are to be identified:

The pulling start point B0, corresponding to the pulling force applied to the fastener, preferably when all the clearances of the tooling and the fastener have been compensated. The pulling force on the screw exerts a compressive force between the threaded portion 212 of the sleeve and the collar 22 of the sleeve that increases with the displacement of the screw 10, as indicated by the portion 502 of the curve;

The buckling point B1 of the sleeve, identified by the pulling force F1 and the displacement X1, is reached when the pulling force exceeds the compressive strength of the sleeve 20 which then starts to buckle. As the screw displacement continues, the sleeve continues to deform to form a bulb 23. This sequence is represented in FIG. 5 by portion 503. The tension exerted on the screw causes the bulb to compress axially, ideally until these two walls come into tight contact with each other;

The contact point of the sleeve B2 with the structure, identified by the pulling force F2 and the displacement X2, is reached when the bulb 23 is compacted on itself and in contact with the blind face 220*b* of part 200*b*, and the structural elements are clamped together and in contact with each other, between the collar 22 and the bulb 23 of the sleeve. In this curve, the pulling force F2 is less than the buckling force F1, but in another installation configuration the pulling force F2 may be equal to or greater than the buckling force F1;

The setpoint B3 is reached when the pulling force F3 reaches a given set force. The force increases substantially between B2 and B3 with a slight displacement of the screw, as indicated by the portion 504 of the curve, indicating an increase in stiffness in the assembly;

The screwing start point S1, corresponding to the torque applied to the screw to bring it back into the sleeve, in a reverse direction of movement. For the purpose of illustration, the displacement of the screw in FIG. 5 is shown at the position at which the pulling force at set point B3 is reached and is represented in the same direction as that of the pulling force, whereas in reality the displacement is of course in the opposite direction to that of the pulling force and may start at a position reached after the pulling force has been reached. The torque increases slightly during this displacement, as indicated by the portion 505 of the curve, with only the frictional forces between the screw thread and the sleeve tapping to overcome;

The contact point of the screw S2 is reached when the screw head 11 is in contact with the collar 22 of the sleeve. In this configuration, the blind fastener comprises two bearing surfaces on each external face of the structures to be assembled: the bulb 23 on the blind face 220*b*, and the assembly comprising the screw head 11 bearing in the collar 22 (for a countersunk fastener) of the sleeve on the front face 210*a*. The torque exerted to the screw then increases substantially—portion 506 of the curve—the additional torque resulting in a pulling force in the screw and a compression force in the assembly;

The fracture point S3, reached when the driving portion fractures under a given torque, depends mainly on the geometry of the shear groove of the screw and the material of the screw.

For a blind fastener installed only by pulling force, the characteristic points to be identified will be among points B0, B1, B2 and B3. For a fastener installed only by screwing, the characteristic points to be identified will be among points C0, C1, C2, and C3 of the curve in FIG. 5B, with the torque-angular displacement curve having the appearance of a pulling force curve like the pulling force curve in FIG. 5A, between points B0 and B3.

Figure 5B:
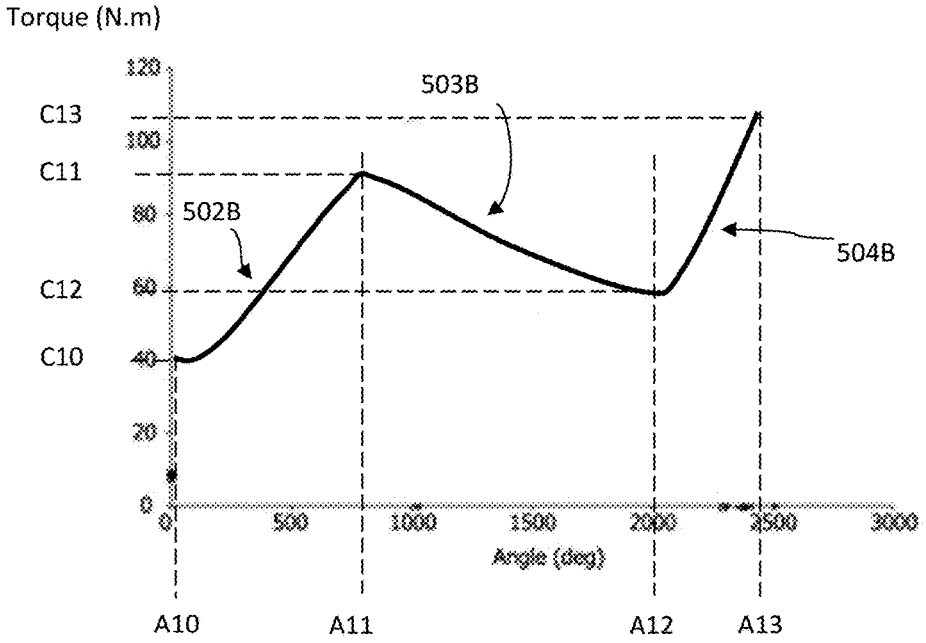
FIG. 5*b* is an installation curve of a blind fastener of the screw type representing the torque applied as a function of an angular displacement of the core bolt during the screwing step.

Thus, for a screwing-only type of fastener 100 detailed above, in which the core bolt is a screw comprising an external thread, at least two of the following four characteristic points are to be identified (FIG. 5B):

The screwing start point C0, corresponding to the start of the torque applied to the fastener, preferably when all the clearances of the tooling and the fastener have been compensated. Screwing in the screw exerts a compressive force between the tapped portion of the sleeve and the collar of the sleeve that increases with screw rotation, as indicated by the portion 502B of the curve;

The buckling point C1 of the sleeve, identified by the torque C11 and the angular displacement A11, is reached when the pulling force exceeds the compressive strength of the sleeve, which then starts to buckle. As the rotation of the screw continues, the sleeve continues to deform to form a bulb. This sequence is represented in FIG. 5B by portion 503B. The rotational force exerted on the screw causes the bulb to compress axially until, ideally, these two walls come into close contact with each other;

The contact point of the sleeve C2 with the structure, identified by the torque C12 and the angular displacement A12, is reached when the bulb is compacted on itself and in contact with the blind face 220*b* of part 200*b*, and the structural elements are clamped together and in contact with each other, between the collar and the bulb of the sleeve;

The fracture point C3, reached when the driving portion fractures under a given torque C13, depends mainly on the geometry of the shear groove of the screw and the material of the screw, as indicated by the portion 504B of the curve, indicating an increase in stiffness in the assembly.

For each of the criteria, one or more parameters based on the values of these points can be used to check whether the criterion is met. In the following description, a non-limiting list of these parameters will be given as an example. Several parameters can be used depending on the level of detection that is desired. The greater the number of parameters used, the better the detection of defective installations.

In the example parameters below, 'X' indicates the absolute value of the core bolt displacement in mm, 'A' indicates the angle of rotation of the fastener in degrees, 'F' indicates the pulling force in N measured during installation, and 'C' indicates a torque in N.m measured during installation. When the core bolt is a threaded screw, the angle of rotation A of the fastener can be transformed into the displacement of the screw or sleeve when the screw is not moving by multiplying the angle of rotation A by the thread pitch of the screw (or sleeve, normally equal to the thread pitch of the screw).

Criterion No. 1—Bulb Formed and in Contact with the Structure

A parameter to check this criterion can be the measurement of the pulling force F1 at the buckling point B1, compared to a range of values that is a function of the force value of the pulling set point F3. For example, the pulling force F1 at the buckling point B1 is correct when it is between 70% and 95% of the force F3, as indicated by equation {1} below. The choice of value range depends on the geometry of the sleeve, its material, the hardness in the portion to be buckled and the tooling used. A value outside this range indicates improper buckling, this may be due to the hardness of the sleeve being below or above an acceptable hardness.

Another parameter may be the value of the slope of the curve portion 504 between the contact point of the sleeve B2 and the setpoint B3. The slope of this curve can be calculated as the ratio R1 between the difference in pulling force (F3-F2) between the setpoint B3 and the contact point of the sleeve B2, and the difference in displacement (X3-X2) between the setpoint B3 and the contact point of the sleeve B2. Alternatively, the ratio R1 can be calculated using the least squares method applied to the curve portion 504.

The ratio R1 is representative of the stiffness of the assembly once the bulb is compacted on itself and on the blind face of the structure, and the structural elements are plated between the collar and the bulb of the sleeve. When this ratio is less than a given value, this parameter indicates that the stiffness of the assembly is less than the expected stiffness, which may indicate an umbrella-shaped bulb, or a reversal of the collar 22, that does not allow for the proper clamping of the assembly. For an 5/32" diameter OPTIBLIND™ fastener, the R1 ratio must be greater than 3,500 N/mm, for example, as indicated by equation {2}.

This threshold value was established statistically on two hundred installations, by distinguishing the proper installations from the deficient ones, and by calculating for each curve the value of the R1 ratio.

Another parameter may be the difference of the displacement X2 at the contact point of the sleeve B2 and the displacement X1 at the buckling point B1 compared to a displacement range of the difference of the displacement X3 at the setpoint B3 and the displacement X0 at the pulling start point B0. For example, the parameter range can be between 38 and 57%, as indicated by the equation {3}.

The values of the range can be different depending on the tooling used for the installation, for example, between 35 and 60% when the installation is performed by a robot.

Another parameter can be the difference in distance between the displacement X2 at the contact point of the sleeve B2 and the displacement X1 at the buckling point B1, depending on the expected diameter of the bulb. The displacement X1-X2 is representative of the reduction in length of the blind-side of the sleeve, linked to the screw by the engaged threads, and indirectly the diameter of the bulb formed. Indeed, if the expected bulb is, for example, equal to 1.5 times the diameter of the drill hole, then the theoretical geometric length reduction is equal to twice the formed bulb radius, minus the drill hole radius, as indicated by equation {4}.

For example, for an 8/32" (6.32 mm) diameter OPTIBLIND™ blind fastener intended to be installed in a 6.35 mm drill hole, the difference in screw displacement between the contact point of the sleeve B2 and the buckling point B1 must be greater than 3.01 mm using equation {4}.

When this parameter is less than 3.01 mm, it means that the bulb has not reached its optimum diameter, either because the installed fastener has a lower clamping capacity than the thickness of the structure, or because the sleeve has not been able to deform for structural reasons, because the hardness of the sleeve is higher than the expected level, for example.

Another parameter can be to compare the difference in fastener angular displacement between the contact point of the screw S2 and the screwing start point S1 to a range of fastener angular displacement, using measurements from the angle sensor 322 without processing this measurement through the processing device 334. The angular displacement between S1 and S2 is an alternative to measuring the displacement between the pulling start point B0 and the setpoint B3—also possible, but more accurate. The angular displacement of the screw corresponds to a translational displacement of the screw. An angular displacement outside the expected range indicates that the screw has too much or too little travel relative to the thickness to be clamped, and therefore that the fastener is not adapted to the thickness to be clamped. An example for an 8/32" diameter OPTIBLIND™ blind fastener is given by the equation {5}.

$$70\%\ F^{B3}<F^{B1}<95\%\ F^{B3} \quad \{1\}$$

$$R1=(F^{B3}-F^{B2})/(X^{B3}-X^{B2})>3{,}500\ \text{N/mm} \quad \{2\}$$

$$38\%(X^{B3}-X^{B0})<(X^{B2}-X^{B1})<57\%(X^{B3}-X^{B0}) \quad \{3\}$$

$$(X^{B2}-X^{B1})>95\%(1.5\times\text{drill hole diameter}-\text{diameter of the drill hole}) \quad \{4\}$$

$$1{,}800°<A_{fastener}{}^{S}2-A_{fastener}{}^{S}1<2{,}850° \quad \{5\}$$

Criterion No. 2—Sufficient Tension is Applied to the Screw

One parameter to check this criterion may be to compare the torque C3 at the fracture point S3 to the expected torque range. If the fracture of the gripper element occurs below the lower limit of the range, the gripper element was probably fractured through a combination of bending and twisting, for example because the tooling was applied to the fastener in a direction other than the normal direction for the fastener. A consequence may be that the tension applied in the screw may not be the expected tension. If the fracture occurs above the upper limit of the range, it may indicate a problem in the installation tooling, or it may indicate that the shear groove does not meet the definition. An example of this parameter is given by equation {6}.

Another parameter may be to compare the difference in the fastener rotation angle between the fracture point S3 and the contact point of the screw S2 to a range of angles. Alternatively, the angle difference can be converted to displacement by multiplying the angle of rotation by the pitch of the screw thread. Indeed, at point S2, the head 11 of the screw normally abuts in or on the collar 22 of the sleeve—depending on the shape of the head, countersunk or protruding. The application of additional torque is not intended to move the screw, which is physically translationally prevented by the sleeve, but is intended to apply tension in the screw, until the force becomes greater than the level of force that the shear groove 12 can support. A displacement above or below a certain level indicates an installation problem or a fastening problem (material, shear groove etc.). An example is given by equation {7}.

Another parameter can be to calculate the slope of the torque-displacement signal between the fracture point S3 and the contact point of the screw S2 and compare it to a range of values. This slope is primarily representative of the elastic deformation of the screw. When the value of this slope is outside the expected range, it may mean that the screw has not deformed enough or has deformed too much in the longitudinal direction X. For example, an insufficiently formed bulb after the pulling step may still be deformed by the rotation of the screw, but the screw will not be stressed, and the slope will be below the lower limit of the range. An example is given by equation {8}.

Another parameter can be to compare the difference between the torque at the fracture point S3 and the average torque between the screw start point S1 and the contact point of the screw S2 to the expected force range. This parameter is representative of the frictional torque between the screw and the sleeve. Excessive friction torques can mean that much of the torque exerted on the screw is not used to apply tension in the screw, which can result in insufficient tension in the screw. An example is given by equation {9}.

Another parameter, alternative to the previous one, can be to compare the torque C2 at the contact point of the screw S2, or the average torque between the screwing start point S1 and the contact point of the screw S2, to a maximum threshold torque value, or to a range of torque values. A value below the lower limit may indicate the absence of a braking device between the screw and the sleeve, which in operation, may cause the screw to loosen. An example is given by equation {10}.

For example, for an 8/32" diameter OPTIBLIND™ blind fastener, these parameters may be:

$$6.5\ \text{Nm}<C^{S3}<8\ \text{Nm} \quad \{6\}$$

$$70°<A_{fastener}{}^{S}3-A_{fastener}{}^{S}2<240° \quad \{7\}$$

$$5\ \text{Nm/mm}<\text{slope}(S3\text{-}S2)<30\ \text{Nm/mm} \quad \{8\}$$

$$5.8\ \text{Nm}<C^{S3}-C^{Average(S1;S2)}<8\ \text{Nm} \quad \{9\}$$

$$0.1\ \text{Nm}<C^{S2}<2\ \text{Nm} \quad \{10\}$$

Optional Criterion No. 3—the Screw Head is in Contact with Sleeve Head

The screw 10 of the OPTIBLIND™ fastener comprises a countersunk or protruding head 11, of enlarged diameter relative to the diameter of the shaft 15, which, when installed in or on the collar 22 of the sleeve, forms the fastener head. For this type of fastener, it is necessary to check that the head 11 of the screw is in contact with the collar 22 of the sleeve. These two elements being on the accessible side, the checking can be done by means of a camera, or by an operator with the use of a block once the fastener is installed.

It is also possible to measure the displacement of the screw 10 on the clamping area between points S1 and S2 and compare it to the displacement of the screw during the pulling step between B0 and B3. Although intuitively the two displacements should theoretically match 100%, a statistical analysis of these displacements can show that this matching is only partial depending on the type of tooling used. For example, for an 8/32" diameter OPTIBLIND™ blind fastener installed with a hand tool, the screw head is in contact with the sleeve collar if the screw displacement over the clamping area between S1 and S2 is between 64% and 90% of the screw displacement between points B0 and B3 during the pulling step, as indicated by equation {11}:

$$64\%(X^{B3}-X^{B0})<(X^{S2}-X^{S1})<90\%(X^{B3}-X^{B0}) \quad \{11\}$$

For the same fastener installed with a robot using another kinematics or installed using separate tools to apply the pulling and torques, the head of the screw is in contact with the collar of the sleeve if the displacement of the screw on the clamping area between S1 and S2 is between 46% and 74% of the displacement of the screw between points B0 and B3 during the pulling step.

Indeed, when the displacements are derived from conversions of rotation angles of the drive shaft and/or rotation angle of the fastener, when the tooling uses elastic means to compensate the displacements of the different elements of the tooling, the calculated displacements are not accurate displacements, they are approximations. Furthermore, the position of the screwing start point S1 may differ from the actual screwing start point depending on the signal processing and point detection algorithms used. The ranges indicated therefore correspond to the correction ranges of the above uncertainties.

Criterion No. 4 Optional—the Screw is Screwed into the Sleeve without Rotation of the Sleeve.

The OPTIBLIND™ fastener is unique in that there are no indentations or means of attachment using a tool on the front face of the collar. During the screwing phase, the rotation of the sleeve is prevented by the resistant friction generated between the contact surfaces of the sleeve 20 and the structure 200, the screw 11 being maintained in tension on the accessible side of the structure. This phenomenon is generally sufficient to prevent any rotation, except for example if the fastener is installed in a too large diameter drill hole, or if the bulb has not reached a sufficient diameter.

The fact that the driving portion breaks at the set force is not in itself sufficient to establish that the sleeve did not rotate during the screwing step and/or fracture point. A rotation may mean that the bulb is not sufficiently pressed against the rear face, or is pressed with some local contact defects, which may induce a loss of pre-load of the structure in operation. Conversely, a slight rotation is not necessarily a sign of defective installation, as the residual preload in the structure may be sufficient for the intended purpose.

If this criterion is used to control the installation of a blind fastener, a first method for detecting a rotation of the sleeve can be simply a visual one, for example a camera visualizing one or more marks on the collar of the sleeve, placed on the accessible side, during or after the installation. These marks can be applied to the collar of the sleeve during manufacture.

A second possible method is to calculate the derivative of the torque-displacement curve on the fractured part between points S2 and S3, and check that it is always positive. Indeed, a negative derivative indicates an unexpected decrease of the torque applied, which is a sign of rotation of the sleeve. Such a parameter would thus comply with equation {12}:

$$\frac{dY_i}{dt_{i\neq i_{S2},i\neq i_{S3}}} > 0 \quad \{12\}$$

A preferred method is to calculate the derivative centered on at least two values between points S2 and S3, and preferably on at least five values, to avoid calculation errors due to the sensitivity of the angle sensor 322 which can induce locally false calculations.

Signal Processing

In the case of a "pull-torque" type blind fastener installation generating a signal covering both the pulling and screwing phases of the core bolt, the processing of the pulling and screwing signals may include three steps:

A step dividing the process into two phases, the first phase corresponding to a pulling step leading to an increasing evolution of the displacement X of the screw 10 between points B0 and B3, and a torquing step leading to a decreasing evolution of the displacement X of the screw 10 between points S1 and S3;

A step for processing the signals of the first phase, and

A processing step of the second phase.

Obviously, in the case of an installation of a fastener installed through only pulling or only screwing, the separation of the two steps does not have to be made.

The step of processing signals from the first, or only, pulling phase may include:

Applying an increasing monotonicity filter to eliminate potential points where the X displacement might decrease or stagnate, A resampling in base space, for example every 0.01 mm.

Point B0 can be identified when the pulling force exceeds a certain threshold value, for example 200 N. This value is indeed sufficient to filter the bearing forces of the tooling on the collar of the sleeve.

Point B1 can be identified by studying the change in slope of the force curve, for example by calculating the derivative of curve portions 502 and 503, and then calculating the difference between a left sliding average over N points and a right sliding average over N points, where N is for example 5. Each of these averages generates a time delay whose difference is a no-delay image of the rate of change of the curve. A rolling average is then applied to filter out the difference. Point B1 is given at the zero-crossing of this curve or at its minimum, if the zero-crossing does not exist.

Point B2 can be identified by minimizing the slope of the portion of curve 504 before reaching the set force and intersecting this slope with the X-axis displacements. From the set point B3, the last points of the curve are scanned, and the slope of the line thus formed is calculated. The minimum of this slope gives the point B2.

Point B3 can be identified as the first overshoot of the set force, for example set at 12,400 N for an OPTIBLIND™ fastener of 8/32" diameter.

The signal processing step of the second screwing phase may include:

Applying a decreasing monotonicity filter to eliminate potential points where the X displacement of the screw could grow or stagnate, A resampling in base space, for example every 0.01 mm, Dividing of the signal into a screwing zone between S1 and S2, represented by curve portion 505 on FIG. 5 and a fracture zone between S2 and S3 represented by the curve 506 on FIG. 5.

When the blind fastener is installed only by screwing, the screw does not move in translation, only the tapped portion of the sleeve moves in the X direction towards the rear side when the bulb is formed. This displacement can be measured indirectly by measuring the angle of rotation imposed on the screw and multiplying this angle by the thread pitch of the screw. For example, a screw with a nominal thread size of 0.1900-32 as per AS8879 UNJF-3A, the thread has a pitch of 0.79 mm. Therefore, a 360° rotation of the screw indicates that the tapping of the sleeve has moved in translation by 0.79 mm.

Point S1 can be identified by looking for the maximum difference between the torque curve and a line through a point $S1_{Max}$, corresponding to the largest displacement of a set of points defined as less than a minimum torque, and a point $S1_{Min}$, corresponding to the smallest displacement of a set of points defined as greater than a maximum torque.

The S2 point can be identified by looking for the maximum of the difference between the torque curve and a line passing through a $S2_{Min}$ point corresponding to the smallest displacement of a set of points defined as being less than a minimum torque, and a $S2_{Max}$ point corresponding to the largest displacement of a set of points defined as being greater than a maximum torque.

Point S3 can be identified as the last torque reached before the fracture point.

In the following description, several examples of defective fastener 100 installations are shown. Table 1 gives a summary of the results for the twelve parameters used in seven examples. A parameter meeting the criterion is noted as "OK", a parameter not meeting the criterion is noted as "NOK".

In some cases of pull-and-screw fastener installations, the process allows you to determine that the installation is defective as soon as the pull step is completed. When the analysis is performed in real time, it is not necessary to screw the screw into the sleeve. It is more interesting for a user to remove the screw by means of the gripping element and then remove the partially deformed sleeve and proceed to a new installation with another fastener. When the analysis is performed after installation, it is not necessary to process the signal from the screwing stage.

Example 1

Figure 6:
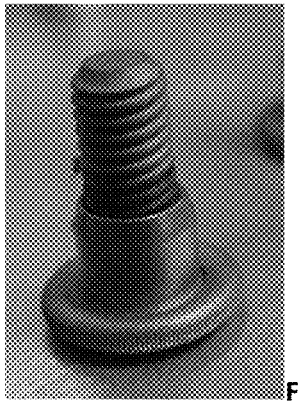
FIG. 6 is the photograph of an umbrella-shaped bulb formed on a blind face.

In this example, a blind fastener 100 with a diameter of 8/32" (6.32 mm) and a minimum grip capacity of 12.50 mm is installed in a structure with a 6.35 mm drill hole and a thickness of 11.90 mm. In this example, which represents an erroneous choice of fastener length—far too long relative to the thickness of the structure—FIG. 6 shows that the sleeve has deformed incompletely, and has a formed an umbrella shape, i.e., only a small annular portion is effectively pressed against the rear face, with the edges of the bulb raised.

The choice of a fastener that is too long is detected by the parameter in equation {5}, which is greater than the upper limit of the expected force range, because the installation required the screw 10 to be screwed into the sleeve 20 over an angular range that is much greater than the angular range of a fastener of correct length.

Example 2

Figure 7:
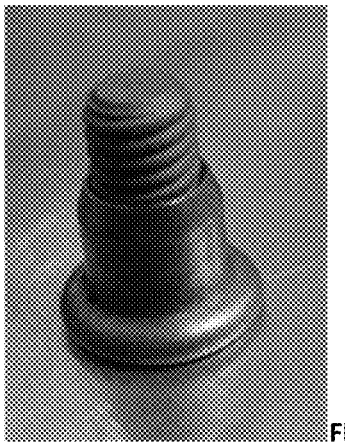
FIG. 7 is the photograph of a bulb formed on a small diameter blind face.

In this example, an 8/32" (6.32 mm) diameter blind fastener with a maximum grip capacity of 11.31 mm is installed in a structure with a 6.35 mm drill hole and 11.90 mm thickness. In this example, which represents an erroneous choice of fastener length—far too short for the thickness of the structure, FIG. 7 is a photograph of the sleeve formed on the blind side during this installation, showing that the sleeve has deformed into a small diameter bulb.

Two defects were detected during the pulling step, notably the parameter {4} relating to the external diameter of the bulb: the calculated value is lower than the expected value, which represents a defect linked to the choice of a fastener that is too short relative to the thickness of the structure to be clamped, having a deformable effective length of the sleeve that is insufficient for this thickness.

Since two parameters only use characteristic points of the pulling step, it would have been possible to stop the installation without calculating the other parameters.

Examples 3 and 4

Figure 8:
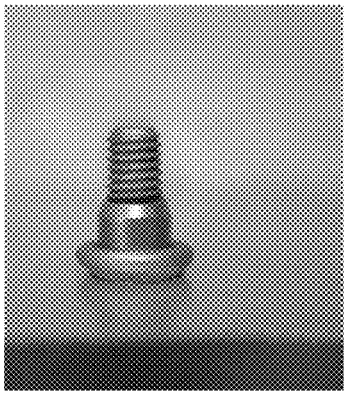
FIG. 8 is the photograph of an umbrella-shaped bulb formed on a blind face.
Figure 9:
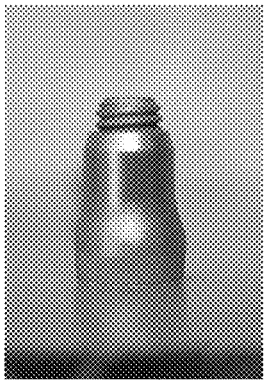
FIG. 9 is the photograph of a bulb formed on a barrel-shaped blind face.

In these examples, a blind fastener with a diameter of 8/32" (6.32 mm) and a grip capacity of 10.91 to 12.90 mm is installed in a structure with a 9/32" (7.14 mm) drill hole, i.e., larger than the fastener diameter, with a thickness of 11.90 mm. FIGS. 8 and 9 are photographs of the sleeve formed on the blind side during these two installations, showing in one image that the sleeve deformed into an umbrella shape and in the second image it formed a barrel shape, i.e., only a slight deformation of the sleeve occurred during the pulling step.

The deformation of the sleeve during the installation of a fastener in an oversized drill hole is unstable, probably due to a lack of bearing of the bulb on the blind face of the structure and/or a lack of coaxiality between the fastener axis and the drill hole axis. Thus, depending on the extent of the defect, the parameters for detecting a defective installation are not all the same.

However, we note that in both examples, the buckling force FB' is well above the expected force range of the parameter {1}.

Several parameters using only characteristic points of the pulling step indicate a defective installation. It would have been feasible to stop the installation without the need to calculate the other parameters.

Example 5

Figure 10:
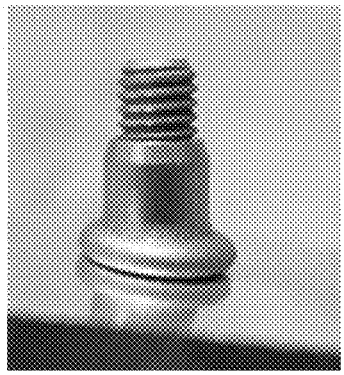
FIG. 10 is the photograph of a bulb formed on a sloping blind face.

In this example, a blind fastener with a diameter of 8/32" (6.32 mm) and a grip capacity of 10.91 mm to 12.90 mm is installed in a structure with a 8/32" (6.35 mm) drill hole, a thickness of 12.90 mm, and a slope of 10° on the rear side, i.e., greater than the recommended slope for installing fastener 100. FIG. 10 is a photograph of the sleeve formed on the blind side during this installation.

In this test, the slope led to defects in the formation of the bulb, which were identified by the parameters in equations {2} to {5}. It is also noted that the parameter in equation {9} relating to the tension applied in the screw is below the lower limit of the expected force range, presumably due to friction of the screw in the sleeve due to the sloping deformation of the bulb, which also rubs on the shaft 15 of the screw 10.

Example 6

Figure 11:
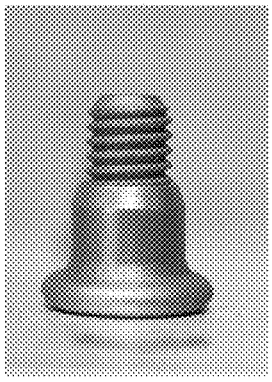
FIG. 11 is the photograph of a bulb formed at a distance from a blind face.

In this example, a blind fastener with a diameter of 8/32" (6.32 mm) and a grip capacity of 10.91 mm to 12.90 mm is installed in a structure with an 8/32" (6.35 mm) drill hole and a thickness of 12.90 mm, without bringing the collar 22 of the sleeve into contact with the countersink in the structure. It is therefore a defective installation. FIG. 11 is a photograph of the sleeve formed on the blind side during this installation, at a distance from the rear side.

Defects were detected during pulling step indicating a bulb formation defect. A characteristic defect of a lack of bearing of the bulb on the rear face is also indicated by equation {12}, showing a rotation of the sleeve during the screwing step, an axial play existing between the ends of the sleeve 20 and the front 210*a* and rear 220*b* faces of the structure.

Example 7

Figure 12:
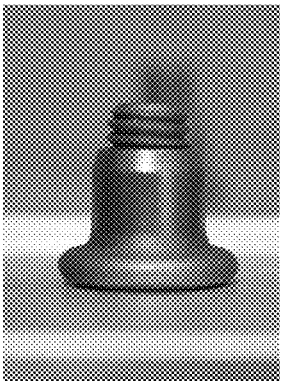
FIG. 12 is another photograph of a bulb formed at a distance from a blind face.

In this example, a blind fastener with a diameter of 8/32" (6.32 mm) and a grip capacity of 10.91 mm to 12.90 mm is installed in a structure with a 8/32" (6.35 mm) drill hole and a thickness of 10.91 mm, without securing the head of the sleeve into the structure's countersink. It is therefore a defective installation. FIG. 12 is a photograph of the sleeve formed on the blind face during this installation, also at a distance from the rear face. During this installation, the head 11 of the screw could not be secured in the collar 22 of the sleeve, without breaking the gripping element 13.

Many parameters indicate a defective installation, relating to defects in the shape of the bulb, the tension applied in the screw, the rotation of the sleeve and of course, a lack of tension applied in the screw.

Table 1 below shows the results of the above examples:

TABLE 1

| Criterion | Equation | Parameter | Ex. 1 | Ex. 2 | Ex. 3 | Ex. 4 | Ex. 5 | Ex. 6 | Ex. 7 |
|---|---|---|---|---|---|---|---|---|---|
| Properly shaped bulb | {1} | $70\% F^{B3} < F^{B1} < 95\% F^{B3}$ | OK | OK | NOK | NOK | OK | OK | OK |
| | {2} | $(F^{B3}-F^{B2})/(X^{B3}-X^{B2}) > 3{,}500$ N/mm | OK | OK | OK | NOK | NOK | OK | OK |
| | {3} | $38\% (X^{B3}-X^{B0}) < (X^{B2}-X^{B1}) < 57\% (X^{B3}-X^{B0})$ | OK | NOK | OK | NOK | NOK | NOK | OK |
| | {4} | $(X^{B2}-X^{B1}) > 3.01$ mm | OK | NOK | OK | NOK | NOK | NOK | NOK |
| | {5} | $1{,}800° < A_{fastener}S2-A_{fastener}S1 < 2{,}850°$ | NOK | NOK | OK | OK | NOK | OK | NOK |
| Tensions applied in the screw | {6} | $6.5 \text{ Nm} < C^{S3} < 8 \text{ Nm}$ | OK | OK | NOK | NOK | OK | OK | NOK |
| | {7} | $70° < A_{fastener}S3-A_{fastener}S2 < 240°$ | OK | OK | OK | NOK | OK | NOK | NOK |
| | {8} | $5 \text{ Nm/mm} < (C^{S3}-C^{S2})/(X^{S3}-X^{S2}) < 30 \text{ Nm/mm}$ | OK | OK | OK | OK | OK | OK | NOK |
| | {9} | $5.8 \text{ Nm} < C^{S3}-C^{Average}_{(S1;S2)} < 8 \text{ Nm}$ | OK | OK | NOK | NOK | NOK | OK | NOK |
| | {10} | $0.1 \text{ Nm} < C^{S2} < 2 \text{ Nm}$ | OK | OK | OK | NOK | OK | OK | NOK |
| Screw head in contact with sleeve collar | {11} | $64\% D^{B0-B3} < D^{S1-S2} < 90\% D^{B0-B3}$ | OK | OK | OK | NOK | OK | OK | NOK |
| screwing the screw into the sleeve is performed without rotation of the sleeve | {12} | $[(dY_i)/d1]_(i \neq i_S2, i \neq i_S3) > 0$ | OK | OK | NOK | NOK | OK | NOK | NOK |

The invention claimed is:

1. A method for controlling the quality of installation of a blind fastener comprising a sleeve and a core bolt, the blind fastener being inserted into a pre-drilled bore hole in a structure, and then locally deformed by a tool that pulls or torques the core bolt to deform the sleeve into a bulb on a rear side of the structure until a driving portion of the core bolt fractures indicating that the installation of the blind fastener is complete, with at least one force-displacement signal and a torque-angle signal having been generated during the installation of the blind fastener, the checking process comprising the following steps:

a) identifying at least two notable points from at least one signal, the at least two notable points having been selected from: a pulling start point (B0) or a screwing start point (S1); a buckling point of the sleeve (B1); a contact point of the sleeve (B2) between the bulb and the rear side of the structure or a contact point of the core bolt (S2) between the head of the core bolt and the collar of the sleeve; and a force setpoint (B3) or a fracture point (S3) of the driving portion of the core bolt;

b) calculating at least one first parameter as a function of at least one of the at least two notable points identified in step a), in order to check that the bulb is formed and is in contact with the rear side of the structure;

c) calculating at least one second parameter as a function of at least one of the at least two notable points identified in step a) in order to check that a predefined tension is applied in the core bolt once the blind fastener has been installed;

d) for at least one of the first and second parameters, comparing the at least one parameter with an associated predefined condition that indicates a proper installation of the fastener; and producing a result signal that the installation is defective if at least one result of the comparison does not meet the predefined condition.

2. The method according to claim 1 comprising an additional step of calculating at least a fourth parameter as a function of at least one of the at least two notable points identified in step a), to check that the sleeve has not rotated while screwing the core bolt into the sleeve.

3. The method according to claim 2, whereby calculating the fourth parameter includes calculating a derivative of a torque-displacement curve between the fracture point (S3) and the contact point of the core bolt (S2) and checking a sign of said derivative.

4. The method according to claim 2, whereby calculating the fourth parameter includes calculating a centered derivative of the torque-displacement curve between the fracture point (S3) and the contact point of the core bolt (S2) over at least two adjacent values and checking a sign of said derivative.

5. The method according to claim 1, comprising an additional step of calculating at least a third parameter, as a function of at least one of the at least two notable points identified in step a), to check that a head of the core bolt is in contact with the collar of the sleeve.

6. The method according to claim 5, whereby calculating the third parameter includes comparing a torque difference between a torque at the contact point of the core bolt (S2) and a torque at the screwing start point (S1) with a percentage range of a pulling force difference between the setpoint force (B3) and the pulling start point force (B0).

7. The method according to claim 1, comprising filtering at least one signal.

8. The method according to claim 7, whereby the filtering comprises: at least one of applying an increasing monotonicity filter to a force-displacement signal corresponding to a pulling step of the core bolt, to eliminate potential points where the displacement (X) might decrease or stagnate, or applying a decreasing monotonicity filter to a force-displacement signal corresponding to a screwing step of the core bolt, to eliminate potential points where a displacement (X) might decrease or stagnate; and resampling in base space.

9. The method according to claim 1, whereby calculating the first parameter includes calculating the pulling force at the buckling point (B1) relative to a percentage range of pulling force at the setpoint (B3).

10. The method according to claim 1, whereby calculating the first parameter includes calculating a ratio of the difference in pulling force between the contact point of the sleeve (B2) and the force setpoint (B3) relative to a difference in displacement between the contact point of the sleeve (B2) and the force setpoint (B3), and comparing the ratio to a minimum value.

11. The method according to claim 1, whereby calculating the first parameter includes calculating a ratio of a difference in displacement between the contact point of the sleeve (B2) and the buckling point (B1), and a displacement of the core bolt between the pulling start point (B0) and the force setpoint (B3), and comparing the ratio to a range of percentages.

12. The method according to claim 1, whereby calculating the first parameter includes calculating a difference in displacement between the contact point of the sleeve (B2) and the buckling point (B1) and comparing it with a percentage of a difference between an expected theoretical bulb diameter and a theoretical diameter of the drill hole into which the fastener is inserted.

13. The method according to claim 1, whereby calculating the second parameter includes comparing a pulling force at the setpoint (B3), or a torque at the fracture point (S3), or a torque at the contact point of the core bolt (S2), with a predefined range of values.

14. The method according to claim 1 whereby calculating the second parameter includes comparing a ratio of a torque difference and a displacement of the core bolt between the fracture point (S3) and the contact point of the core bolt (S2) with a predefined range of values.

15. The method according to claim 1, whereby calculating the second parameter includes comparing a difference of a rotation angle of the core bolt between the contact point of the core bolt (S2) and the screwing start point (S1) with a predefined value range.

16. The method according to claim 1 whereby calculating the second parameter includes comparing a difference between a torque at the fracture point (S3) and an average of a torque between the contact points of the core bolt (S2) and the screwing start point (S1) with a predefined range of values.

* * * * *